US005752143A

United States Patent [19]

Wayman

[11] Patent Number: 5,752,143

[45] Date of Patent: May 12, 1998

[54] LIQUID IMMERSION DEVELOPMENT APPARATUS HAVING EFFICIENT CHARGE DISSIPATING DEVELOPMENT ELECTRODE

[75] Inventor: William H. Wayman, Ontario, N.Y.

[73] Assignee: Xerox Corporation, Stamford, Conn.

[21] Appl. No.: 792,951

[22] Filed: Jan. 21, 1997

[51] Int. Cl.[6] ..... G03G 15/10

[52] U.S. Cl. ..... 399/248; 399/237; 399/240; 399/241; 430/119

[58] Field of Search ..... 399/237, 240, 399/241, 244, 248, 348; 430/125, 119

[56] References Cited

U.S. PATENT DOCUMENTS

| | | | |
|---|---|---|---|
| 3,831,556 | 8/1974 | Sato et al. | 399/244 |
| 4,286,039 | 8/1981 | Landa et al. | 430/119 |
| 4,878,090 | 10/1989 | Lunde | 399/240 |
| 4,985,733 | 1/1991 | Kurotori et al. | 399/156 |
| 5,032,871 | 7/1991 | Murata et al. | 399/248 X |
| 5,120,630 | 6/1992 | Wadlo et al. | 399/241 X |
| 5,136,334 | 8/1992 | Camis et al. | 399/233 |
| 5,332,642 | 7/1994 | Simms et al. | 430/125 |

FOREIGN PATENT DOCUMENTS 55-079475 6/1980 Japan .

*Primary Examiner*—Arthur T. Grimley
*Assistant Examiner*—Sophia S. Chen
*Attorney, Agent, or Firm*—Tallam I. Nguti

[57] ABSTRACT

In an electrostatographic liquid immersion development (LID) reproduction machine having an image bearing member having an image bearing surface, a development apparatus having a development electrode for forming a development nip with the image bearing surface and for effectively dissipating residual counter charges from the development nip. The development apparatus includes a housing mounted against the image bearing member and defining a sump portion, a conduit member having a development opening, a recovery chamber, and an opening into the recovery chamber. The development electrode consists of a conductive development shoe and a bias source connected to the development shoe. The development electrode is mounted across the development opening of the conduit member, and closely spaced from the image bearing surface for forming the development nip. Importantly, the development electrode has pores therethrough for preventing undesirable residue build-up on the development shoe, and thereby effectively dissipating residual counter charges from the development nip, thus increasing developability of image areas and cleanliness of image background areas.

3 Claims, 2 Drawing Sheets

LIQUID IMMERSION DEVELOPMENT APPARATUS HAVING EFFICIENT CHARGE DISSIPATING DEVELOPMENT ELECTRODE

BACKGROUND OF THE INVENTION

This invention relates to liquid immersion development (LID) reproduction machines, and more particularly to such a machine including a (LID) development apparatus having a development electrode for effectively dissipating residual counter charges in a development nip, thus increasing toner image developability and cleanliness of image background areas.

Liquid electrophotographic reproduction machines are well known, and generally each includes an image bearing member or photoreceptor having an image bearing surface on which latent images are formed and developed as single color or multiple color toner images for eventual transfer to a receiver substrate or copy sheet. Each such reproduction machine thus includes a development system or systems that each utilizes a liquid developer material typically having about 2 percent by weight of charged, solid particulate toner material of a particular color, that is dispersed at a desired concentration in a clear liquid carrier.

In the electrophotographic process of a LID machine, the latent images formed on the image bearing surface of the image bearing member or photoreceptor are developed with the charged toner particles, with excess liquid carrier being left behind or removed such that the developed images typically each contain about 12 percent by weight of the toner particles. The developed image or images on the image bearing member are then further conditioned and subsequently electrostatically transferred from the image bearing surface to an intermediate transfer member. Following that, the conditioned image or images are then hot or heat transferred from the intermediate transfer member, at a heated transfer or transfix nip, to an output image receiver substrate or copy sheet.

LID machines, as above, conventionally include a liquid developer material or ink applicator for supplying or applying an even layer of the liquid developer material (containing charged toner particles and liquid carrier) into a development nip for image development. Ordinarily, the charged toner particles contain both positive and negative charges, and the image areas on the image bearing surface are charged to a particular polarity, for example, a relatively positive polarity. In LID machines where development is achieved by means of a solid, flat development electrode that forms the development nip, an appropriate electrode bias is applied to toner particles within the development nip in order to appropriately separate the positive and negative charges in the toner particles. For example, where the image areas on the image bearing surface have a relatively positive polarity, the charges in the toner particles will be appropriately separated so that negative charges are retained in the toner particles to enable development, and so that the separated positive charges from the toner particles (hereinafter "counter charges") are attracted to the biased development electrode for dissipation.

Unfortunately, it has been found that over time, residual "counter charges" tend to build up on conventional development electrode, due in part to a build up on the development electrode of toner particles and developer material residue. Such a build up of residual "counter charges" on the development electrode, and within the development nip tend to adversely result in subsequent poor or inadequate "counter charge" dissipation or neutralization. Such poor counter charge dissipation ordinarily causes poor image area development, and poorly cleaned image background areas. The net result typically is poorly developed, and less than high quality transferred, toner images.

There is therefore a need for a LID reproduction machine including a development apparatus having an efficient counter charge dissipating development electrode for effectively dissipating residual counter charges in the development nip, thus increasing developability of image areas and cleanliness of image background areas.

SUMMARY OF THE INVENTION

In accordance with the present invention, there is provided in an electrostatographic liquid immersion development (LID) reproduction machine having an image bearing member having an image bearing surface, a development apparatus having a development electrode for forming a development nip with the image bearing surface and for effectively dissipating residual counter charges from the development nip. The development apparatus includes a housing mounted against the image bearing member and defining a sump portion, a conduit member having a development opening, a recovery chamber, and an opening into the recovery chamber. Importantly, the development electrode consists of a conductive development shoe and a bias source connected to the development shoe. The development shoe is mounted across the development opening of the conduit member, and closely spaced from the image bearing surface for forming the development nip. Importantly, the development shoe has pores therethrough for preventing undesirable residue build-up on the development shoe, and thereby effectively dissipating residual counter charges from the development nip, thus increasing developability of image areas and clean image background areas.

BRIEF DESCRIPTION OF THE DRAWINGS

Other aspects of the present invention will become apparent as the following description proceeds and upon reference to the drawings, in which.

DETAILED DESCRIPTION OF THE INVENTION

Figure 1:
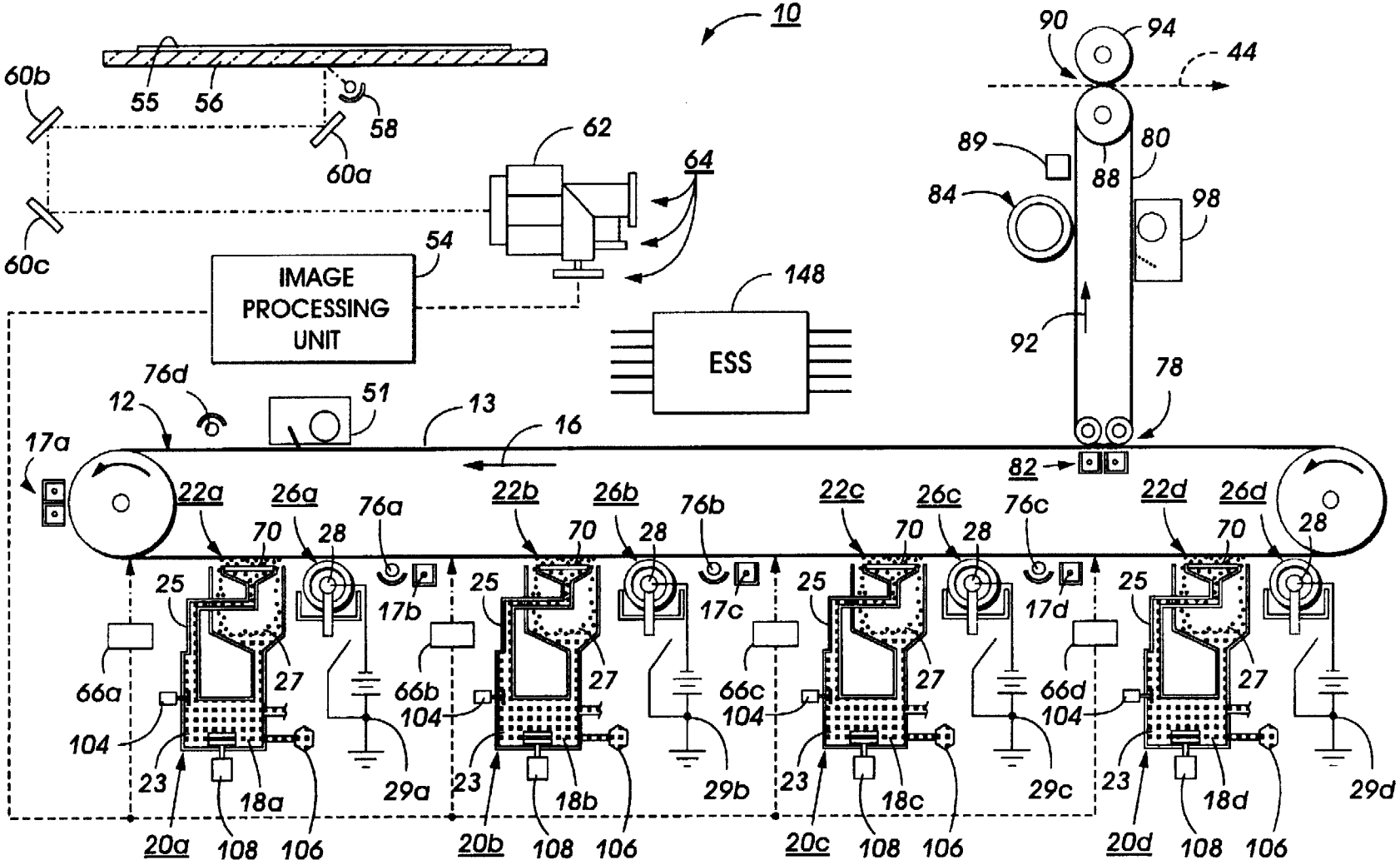
FIG. 1 is a vertical schematic of an exemplary color electrophotographic liquid immersion development (LID) reproduction machine incorporating a number of the development apparatus in accordance with the present invention.

For a general understanding of the features of the present invention, reference numerals have been used throughout to designate identical elements. It will become evident from the following discussion that the present invention is equally well suited for use in a wide variety of reproduction machines and is not necessarily limited in its application to the particular embodiment depicted herein.

Inasmuch as the art of electrophotographic reproduction is well known, the various processing stations employed in the FIGS. 1 and 2 of the reproduction machine will be shown hereinafter only schematically, and their operation described only briefly.

Referring now to FIG. 1, there is shown a color electrophotographic reproduction machine 10 incorporating a development system including the filming attenuation correcting toner concentration sensor assembly of the present invention. Although a multiple color LID machine is illustrated, it is understood that the invention is equally suitable for a single color LID machine. The color copy process of the machine 10 can begin by either inputting a computer generated color image into an image processing unit 54 or by way of example, placing a color document 55 to be copied on the surface of a transparent platen 56. A scanning assembly consisting of a halogen or tungsten lamp 58 which is used as a light source, and the light from it is exposed onto the color document 55. The light reflected from the color document 55 is reflected, for example, by a 1st, 2nd, and 3rd mirrors 60*a*, 60*b* and 60*c*, respectively through a set of lenses (not shown) and through a dichroic prism 62 to three charged-coupled devices (CCDs) 64 where the information is read. The reflected light is separated into the three primary colors by the dichroic prism 62 and the CCDs 64. Each CCD 64 outputs an analog voltage which is proportional to the intensity of the incident light.

The analog signal from each CCD 64 is converted into an 8-bit digital signal for each pixel (picture element) by an analog/digital converter (not shown). Each digital signal enters an image processing unit 54. The digital signals which represent the blue, green, and red density signals are converted in the image processing unit 54 into four bitmaps: yellow (Y), cyan (C), magenta (M), and black (Bk). The bitmap represents the value of exposure for each pixel, the color components as well as the color separation. Image processing unit 54 may contain a shading correction unit, an undercolor removal unit (UCR), a masking unit, a dithering unit, a gray level processing unit, and other imaging processing sub-systems known in the art. The image processing unit 54 can store bitmap information for subsequent images or can operate in a real time mode.

The machine 10 includes a photoconductive imaging member or photoconductive belt 12 which is typically multilayered and has a substrate, a conductive layer, an optional adhesive layer, an optional hole blocking layer, a charge generating layer, a charge transport layer, a photoconductive or image bearing surface 13, and, in some embodiments, an anti-curl backing layer. As shown, belt 12 is movable in the direction of arrow 16. The moving belt 12 is first charged by a charging unit 17*a*. A raster output scanner (ROS) device 66*a*, controlled by image processing unit 54, then writes a first complementary color image bitmap information by selectively erasing charges on the charged belt 12. The ROS 66*a* writes the image information pixel by pixel in a line screen registration mode. It should be noted that either discharged area development (DAD) can be employed in which discharged portions are developed or charged area development (CAD) can be employed in which the charged portions are developed with toner.

Figure 2:
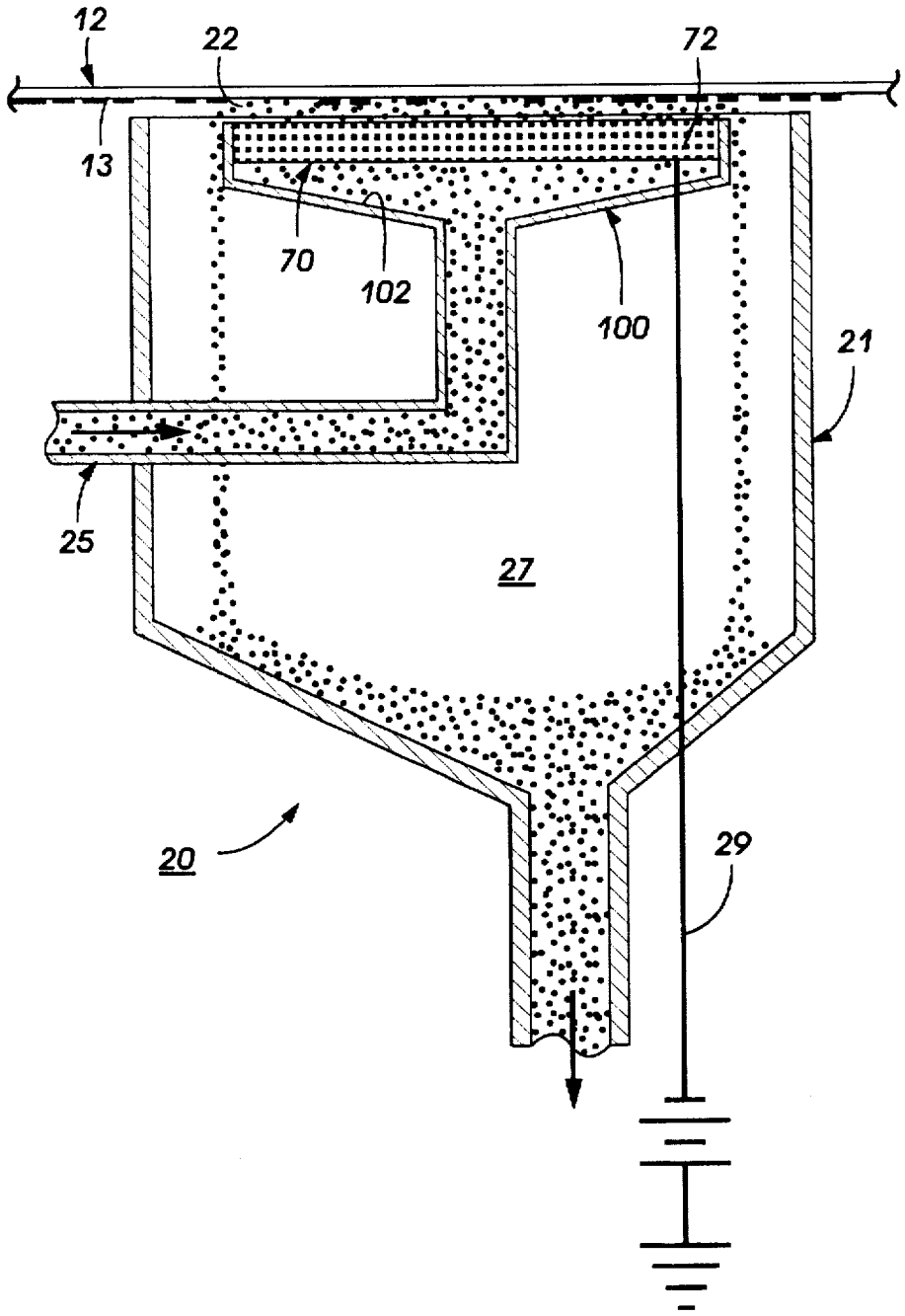
FIG. 2 is a vertical schematic of a portion of the development apparatus of FIG. 1, illustrating the increased process speed development electrode for effectively dissipating residual counter charges in the development nip, thus increasing image areas developability and clean image background areas of the present invention.

Referring now to FIGS. 1 and 2, after the electrostatic latent image has been recorded thus, belt 12 advances the electrostatic latent image to a first development apparatus 20*a* in accordance with the present invention. Like each subsequent development apparatus 20*b*, 20*c*, and 20*d*, the development apparatus 20*a* includes a housing 21 defining a mixing chamber 23, a developer material delivery conduit 25 having a development opening, a porous, conductive development shoe or electrode 70 of the present invention, an electrode biasing source 29, and a spent developer material recovery chamber 27. The porous, conductive development shoe or electrode 70 receives a quantity of liquid developer material 18*a*, preferably black toner developer material containing black toner particles at a desired concentration. The developer material is delivered or fed through the shoe or electrode 70 via the conduit 25, and into an image development and "counter charge" neutralization nip 22*a*. Within the nip 22*a*, appropriate electrode biasing by the source 29 causes positive and negative charges in toner particles therein to separate. Toner particles retaining separated charges relatively opposite to a polarity of the image areas of the first electrostatic latent image, are disseminated at the desired concentration through the liquid carrier, and pass by electrophoresis to the electrostatic latent image to form a first liquid color separation toner image. The unretained separated or "counter charges" are attracted to the development shoe or electrode 70 for efficient dissipation or neutralization in accordance with the present invention.

After the first liquid color separation image is developed, for example, with black liquid toner, it is yet a low solids content image, and it is then conditioned by a biased image conditioning and metering device 26*a*, which is biased by a source 29*a*, and is the same as subsequent identical image conditioning and metering devices 26*b*, 26*c*, 26*d*. The biased device 26*a*, 26*b*, 26*c*, 26*d* (biased by appropriate sources 29*a*, 29*b*, 29*c*, and 29*d* respectively) as mounted contacts the low solids image on belt 12 and conditions it by compacting the toner particles form the image. Such compacting reduces the fluid content of the image (thus increasing its percent solids resulting in a high solids content image) while inhibiting the departure of toner particles from the image. Preferably, the percent solids content achieved in the high solids image is more than 20 percent by weight. A vacuum device 28 located on one end of the image conditioning and metering device 26*a*, 26*b*, 26*c*, 26*d*, draws liquid that has permeated into the device, out through such end. Vacuum device 28 deposits the liquid in a receptacle or some other location for either disposal or recirculation as liquid carrier.

In operation, the biased image conditioning and metering device 26*a*, 26*b*, 26*c*, 26*d* rotates in a direction as shown with desired contact against the low solids image on belt 12. The low solids conditioned image on belt 12 is then advanced to lamp 76*a* which floods the surface 13 with light for erasing residual charge left on the surface 13.

As shown, according to the REaD process of the machine 10, the liquid toner image on belt 12 is subsequently recharged with charging unit 17*b*, and is next re-exposed by ROS 66b. ROS 66b superimposing a second color image bitmap information over the previous developed latent image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other. Also, during subsequent exposure, the image is re-exposed in a line screen registration oriented along the process or slow scan direction. This orientation reduces motion quality errors and allows the utilization of near perfect transverse registration.

At the second development apparatus 20*b* in accordance with the present invention, a porous, conductive development shoe or electrode 70, biased by a source 29, receives a liquid developer material 18*b*, containing toner particles at a desired toner concentration, from the delivery conduit 25, into a second image development and "counter charge" neutralization nip 22*b*. Within the nip 22*b*, appropriate electrode biasing by the source 29 causes positive and negative charges in toner particles therein to separate. Toner particles retaining separated charges relatively opposite to a polarity of the image areas of the second electrostatic latent image, are disseminated at the desired concentration through the liquid carrier, and pass by electrophoresis to the electrostatic latent image to form a second liquid color separation toner image. The unretained separated or "counter charges" are attracted to the development shoe or electrode 70 for efficient dissipation or neutralization in accordance with the present invention.

The second low solids image conditioning and metering device **26*b* contacts the second low solids image on belt 12** and conditions it similarly by sufficiently compacting the toner particles forming it, thereby reducing its fluid content. Preferably, the percent solids achieved is more than 20 percent, however, the percent of solids can range between 15 percent and 40 percent.

The conditioned images on belt 12 are advanced to lamp **76*b* where any residual charge left on the photoconductive surface 13 is erased by flooding the photoconductive surface with light from lamp 76*b*. Then to similarly produce the third color separation image using the third toner color, for example magenta color toner, the toner images on moving belt 12 are recharged with charging unit 17*c*, and re-exposed by a ROS 66c**, which superimposes a latent electrostatic third color image bitmap information over the previous developed latent image.

At the third development apparatus **20*c* in accordance with the present invention, a porous, conductive development shoe or electrode 70, biased by a source 29, receives magenta liquid developer material 18*c*, containing toner particles at a desired toner concentration, from the delivery conduit 25, and into a third image development and "counter charge" neutralization nip 22*c*. Within the nip 22*c*, appropriate electrode biasing by the source 29 causes positive and negative charges in toner particles therein to separate. Toner particles retaining separated charges relatively opposite to a polarity of the image areas of the third electrostatic latent image, are disseminated at the desired concentration through the liquid carrier, and pass by electrophoresis to the electrostatic latent image to form a third liquid color separation toner image. The unretained separated or "counter charges" are attracted to the development shoe or electrode 70** for efficient dissipation or neutralization in accordance with the present invention.

A third conditioning device **26*c* contacts the third developed low solids image on belt 12** and conditions it by compacting it, thus reducing its fluid content to produce a percent solids within a range between 15 percent and 40 percent.

The images or composite image on belt 12 are advanced to lamp **76*c* where any residual charge left on the photoconductive surface of belt 12 is erased by flooding the photoconductive surface with light from the lamp. Then finally, to similarly produce the fourth image using the fourth toner color, for example cyan color toner, the toner images on moving belt 12 are recharged with charging unit 17*d*, and re-exposed by a ROS 66d. ROS 66d** superimposes a latent fourth color image bitmap information over the previous developed latent images.

At the fourth development apparatus **20*d* in accordance with the present invention, porous, conductive development shoe or electrode 70, biased by a source 29, receives a cyan liquid developer material 18*d*, containing toner particles at a desired toner concentration, from the delivery conduit 25, and into a fourth image development and "counter charge" neutralization nip 22*d*. Within the nip 22*d*, appropriate electrode biasing by the source 29 causes positive and negative charges in toner particles therein to separate. Toner particles retaining separated charges relatively opposite to a polarity of the image areas of the fourth electrostatic latent image, are disseminated at the desired concentration through the liquid carrier, and pass by electrophoresis to the electrostatic latent image to form a fourth liquid color separation toner image. The unretained separated or "counter charges" are attracted to the development shoe or electrode 70** for efficient dissipation or neutralization in accordance with the present invention.

A fourth conditioning device **26*d* contacts the developed images on belt 12** and conditions them by reducing their fluid content so that the images have a percent solids within a range between 15 percent and 40 percent. It should be evident to one skilled in the art that the color of toner at each development station could be in a different arrangement.

The resultant composite multicolor image, a multi layer image by virtue of different color toner development by the devices **20*a*, 20*b*, 20*c* and 20*d*, respectively having black, yellow, magenta, and cyan, toners, is then advanced to an intermediate transfer station 78. At the transfer station 78, the multicolor image is electrostatically transferred to an intermediate member 80 with the aid of a charging device 82. Intermediate member 80 may be either a rigid roll or an endless belt, as shown, having a path defined by a plurality of rollers including roller 88, that are in contact with the inner surface thereof. The multicolor image on the intermediate transfer member 80 is conditioned again for example by a blotter roller 84 which further reduces the fluid content of the transferred image by compacting the toner particles thereof while inhibiting the departure of the toner particles. Blotter roller 84** is adapted to condition the image so that it has a toner composition of more than 50 percent solids.

Subsequently, the reconditioned image on the surface of the intermediate member 80 is advanced through a liquefaction stage before being transferred within a second transfer nip 90 to an image recording sheet 44. Within the liquefaction stage, particles of toner forming the transferred image are transformed by a heat source 89 into a tackified or molten state. The heat source 89 can also be applied to member 80 internally. The intermediate member 80 then continues to advance in the direction of arrow 92 until the tackified toner particles reach the transfer nip 90.

The transfer nip 90 is more specifically a transfixing nip, where the multicolor image is not only transferred to the recording sheet 44, but it is also fused or fixed by the application of appropriate heat and pressure. At transfix nip 90, the liquefied toner particles are forced, by a normal force applied through a backup pressure roll 94, into contact with the surface of recording sheet 44. Moreover, recording sheet 44 may have a previously transferred toner image present on a surface thereof as the result of a prior imaging operation, i.e. duplexing. The normal force, produces a nip pressure which is preferably about 20 psi, and may also be applied to the recording sheet via a resilient blade or similar spring-like member uniformly biased against the outer surface of the intermediate member across its width.

As the recording sheet 44 passes through the transfix nip 90 the tackified toner particles wet the surface of the recording sheet, and due to greater attractive forces between the paper and the tackified particles, as compared to the attraction between the tackified particles and a liquid-phobic surface of member 80, the tackified particles are completely transferred to the recording sheet. As shown, the surface of the intermediate transfer belt 80 is thereafter cleaned by a cleaning device 98 prior to receiving another toner image from the belt 12.

Invariably, after the multicolor image was transferred from the belt 12 to intermediate member 80, residual liquid developer material remained adhering to the photoconductive surface of belt 12. A cleaning device 51 including a roller formed of any appropriate synthetic resin, is therefore provided as shown and driven in a direction opposite to the direction of movement of belt 12 to scrub the photoconductive surface clean. It is understood, however, that a number of photoconductor cleaning means exist in the art, any of which would be suitable for use with the present invention. Any residual charge left on the photoconductive surface after such cleaning is erased by flooding the photoconductive surface with light from a lamp **76*d* prior to again charging the belt 12** for producing another multicolor image as above.

As illustrated the reproduction machine 10 further includes an electronic control subsystem (ESS) shown as 148 for controlling various components and operating subsystems of the reproduction machine. ESS 148 thus may be a self-contained, dedicated minicomputer, and may include at least one, and may be several programmable microprocessors for handling all the control data including control signals from control sensors for the various controllable aspects of the machine.

Referring now to FIGS. 1 and. 2, the development apparatus **20*a*, 20*b*, 20*c*, and 20*d* of the present invention are each represented by a common development apparatus shown as 20 and partially illustrated (FIG. 2). As shown, the development apparatus 20 includes a housing 21 that defines a liquid developer material holding and mixing chamber or sump 23, a conduit member 25, a recovery chamber 27, and an opening into the recovery chamber 27. As further shown, the conduit member 25 includes an open funnel shaped portion 100 having a development opening therein positioned closely spaced from the image bearing surface 13**.

Importantly, in accordance with the present invention, the development apparatus 20 (FIG. 2) the conductive development shoe or electrode 70 includes pores 72 therethrough, through which liquid developer material flows, thereby carrying developer material residues with it and preventing undesirable residue build-up on the top surface thereof. The development shoe or electrode 70, as shown, is mounted across the development opening of the funnel portion 100, and closely spaced from the image bearing surface 13 to form a development and "counter charge" dissipation nip 22. As shown, liquid developer material delivered through the conduit member 25 into the funnel portion 100, is forcibly pushed through the pores 72 into the development and charge neutralization nip 22, and into development contact with a latent image on the image bearing surface 13. During normal operation, developer material forced through the pores 72 as such, is biased within the nip 22 by the source 29, resulting in toner charge separation as described above. Toner particles containing appropriate retained separated charges develop the latent image, and the other separated, "counter charges" are attracted to the biased shoe or electrode 70 for efficient dissipation in accordance with the present invention.

To prevent residue build up, even within the funnel portion 100 of the conduit 25, (ordinarily like to occur for example when the system is shut down), the funnel portion 100 includes slanted bottom surfaces 102 for allowing developer material therein to flow back into the mixing sump 23.

Preferably, in accordance with the present invention, the bias source 29 for biasing the development shoe or electrode 70, has the same polarity and potential as each of the bias source **29*a*, 29*b*, 29*c*, and 29*d* for biasing the downstream image conditioning and metering devices 26*a*, 26*b*, 26*c* and 26*d***, as disclosed above.

The development apparatus 20 (FIG. 1) further includes a liquid developer material delivery means such as a pump 104 that is connected to the sump 23 for pumping and forcing liquid developer material through the pores 72 of the development shoe or electrode 70, and into development contact with a latent image on the surface 13. Preferably, the development shoe or electrode 70 has a length corresponding to a width of the image bearing surface 13, and a width that spans a width of the development opening of the funnel portion 100. The width as such should be sufficiently wide for achieving a desired "counter charge" neutralization dwell time in the nip 22.

As further illustrated, the development apparatus 20 includes adding means 106 for adding a controllable amount of charged toner particles into the sump portion 23, as well as mixing means 108 for mixing material within the sump 23, so as to maintain at a desired level, a toner particle concentration of the liquid developer material being delivered through to the pores 72 of the development shoe or electrode 70.

Since the development shoe or electrode 70, biased by the source 29, is suitable for effectively dissipating residual counter charges in the development nip 22, image areas developability is improved, and so is cleanliness of image background areas in transferred toner images. The development apparatus 20 having such a porous biased development shoe or electrode, advantageously provides for a continuous flow of liquid developer material through the pores 72 thereof. The porous surface thereof in combination with the forceful flow of liquid developer material through it, thus acts to limit the buildup of charge residue on the shoe surface.

To recapitulate, the porous shoe or electrode 70 is made effectively eliminates the problem of toner and residue build-up on the shoe by providing the cleaning action of the liquid developer material forcibly flowing up through the pores 72, and over the edges of the shoe or electrode 70, back into the recovery chamber 27. With such a clean development electrode for effectively dissipating residual counter charges in the development nip, image areas developability is improved, and so is the cleanliness of image background areas of transferred toner images.

While the invention has been described with reference to particular preferred embodiments, the invention is not limited to the specific examples shown, and other embodiments and modifications can be made by those skilled in the art without depending from the spirit and scope of the invention and claims.

What is claimed is:

1. A liquid immersion development (LID) reproduction machine comprising:

(a) a movable image bearing member having an image bearing surface defining a path of movement;

(b) means mounted along said path of movement for forming a latent image onto said image bearing surface;

(c) a development apparatus mounted along said path of movement containing liquid developer material consisting of a liquid carrier and solid charged toner particles for biasing to generate separated counter charges for dissipation, and development charges for developing the latent image to create a toner developed image, said development apparatus including:

(i) a housing defining an opening, a recovery chamber, and a sump containing said liquid developer material;

(ii) a conduit member connected to said sump and having a development opening positioned closely spaced from said image bearing surface;

(iii) means connected to said sump for delivering liquid developer material from said sump through said conduit member towards said image bearing surface for image development;

(iv) a biased conductive development electrode, forming a development nip with said image bearing surface, for efficiently dissipating separated counter charges within said development nip, said development electrode having pores therethrough for enabling flowthrough of liquid developer material delivered into said development nip, thereby preventing undesirable residue build-up on said development electrode, as well as, undesirable residual counter charge build up within the development nip, and said development electrode also having a length corresponding to a width of the image bearing surface, and a width for achieving a desired counter charge dissipation; and (v) liquid developer material delivery means connected to said sump for delivering liquid developer material through said pores of said development electrode into development contact with a latent image on said image bearing surface.

2. In an electrostatographic liquid immersion development (LID) reproduction machine having an image bearing member having an image bearing surface, a development apparatus comprising:

(a) a housing mounted against the image bearing member, said housing defining a sump portion, a conduit member having a development opening, a recovery chamber, and an opening into said recovery chamber;

(b) liquid developer material contained in said sump portion including a liquid carrier and charged toner particles for biasing in a development nip to generate separated counter charges for dissipation by a development electrode, and development charges for developing a latent image on said image bearing member;

(c) a conductive development electrode, forming a development nip with said image bearing surface, for efficiently dissipating separated counter charges within said development nip, said conductive development electrode having pores therethrough for enabling flowthrough of liquid developer material, thereby preventing undesirable residue build-up on said conductive development electrode, as well as, undesirable residual counter charge build up within said development nip, said conductive development electrode having a length corresponding to a width of the image bearing surface, and a width for achieving a desired counter charge dissipation;

(d) a bias source connected to said conductive development electrode for biasing said conductive development electrode, thereby enabling effective dissipation of residual counter charges in the development nip, and increasing developability of image areas and cleanliness of image background areas; and (e) liquid developer material delivery means connected to said sump for delivering liquid developer material through said pores of said conductive development electrode into development contact with a latent image on said image bearing surface.

3. The development apparatus of claim 1, including adding means for adding a controllable amount of charged toner particles into said sump portion so as to maintain at a desired level, a toner particle concentration of the liquid developer material being delivered through said pores of said conductive development electrode.

* * * * *